United States Patent [19]

Niles et al.

[11] Patent Number: 5,033,778

[45] Date of Patent: Jul. 23, 1991

[54] INTEGRAL OVER-CENTER TOGGLE LATCH FOR USE WITH A MOLDED CASE

[75] Inventors: Gerald J. Niles; Davis W. Chamberlin; Jacqueline J. Forbes, all of St. Paul, Minn.

[73] Assignee: Minnesota Mining and Manufacturing Company, St. Paul, Minn.

[21] Appl. No.: 509,234

[22] Filed: Apr. 16, 1990

[51] Int. Cl.[5] ..... E05C 5/02; A45G 3/02

[52] U.S. Cl. ..... 292/66; 220/315; 206/1.5; 206/387; 292/DIG. 38; 292/DIG. 49

[58] Field of Search ..... 292/DIG. 38, DIG. 48, 292/DIG. 49, DIG. 31, 85, 173, 66, DIG. 42; 206/1.5, 387; 220/315, 321

[56] References Cited

U.S. PATENT DOCUMENTS

| | | | |
|---|---|---|---|
| 3,134,617 | 5/1964 | Slonneger | 292/83 |
| 3,466,076 | 9/1969 | Bisbing | 292/DIG. 49 |
| 3,490,805 | 1/1970 | Pierro et al. | 292/DIG. 49 |
| 3,809,219 | 5/1974 | Esashi | 206/1.5 |
| 4,011,940 | 5/1977 | Neal et al. | 206/1.5 |
| 4,363,403 | 12/1981 | Raucci, Jr. et al. | 292/175 |
| 4,407,536 | 10/1983 | Kausch | 292/29 |
| 4,532,674 | 8/1985 | Tobey et al. | 292/113 |
| 4,588,216 | 5/1986 | Hinds | 292/113 |
| 4,682,800 | 7/1987 | Lovelace, Jr. | 292/247 |
| 4,687,237 | 8/1987 | Bisbing | 292/78 |
| 4,713,735 | 3/1989 | Avitable | 296/100 |
| 4,744,445 | 5/1988 | Anderson et al. | 292/DIG. 42 |

*Primary Examiner*—Eric K. Nicholson

*Attorney, Agent, or Firm*—Gary L. Griswold; Walter N. Kirn; Charles D. Levine

[57] ABSTRACT

An over-center toggle latch which can be integrally molded with the first and second members of a case. The over-center toggle latch includes a hinge arm that has first and second spaced ends. A first living hinge attaches the first end of the hinge arm to the first case member. A second living hinge is for coupling a lever arm to the second end of the hinge arm. An engagement member-receiving seat is formed on the second member of the case. An engagement member is mounted to the lever arm and is spaced from the second hinge. The engagement member pivotally engages the seat with the hinge arm in an over-center position with respect to the engagement member. The latch is configured for use with first and second case members that have sides and edges. When the first and second case members are secured by the latch, the edges are generally coplanar and perpendicular to the sides. When latched, the latch arm is positioned within recesses in the edges while the handle is positioned within a recess in the second member.

15 Claims, 3 Drawing Sheets

10
12
14
16
18
20
22
24
26
28
30
32
34
36
38
40
42
50
52

Fig. 3
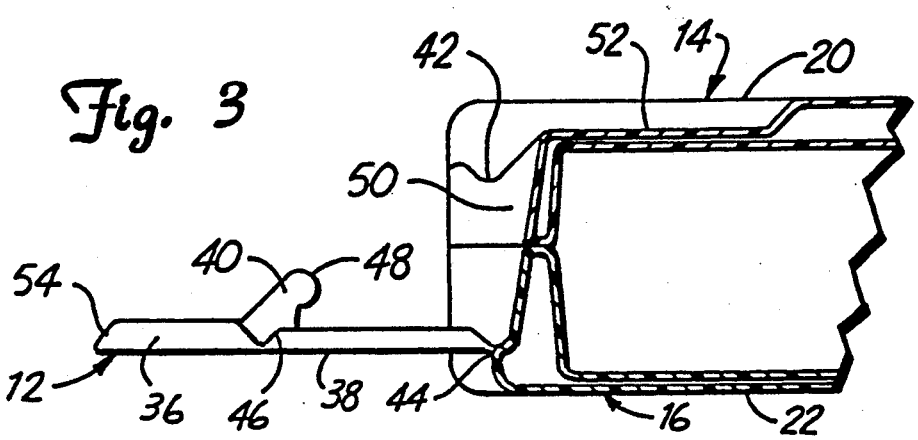
Fig. 4
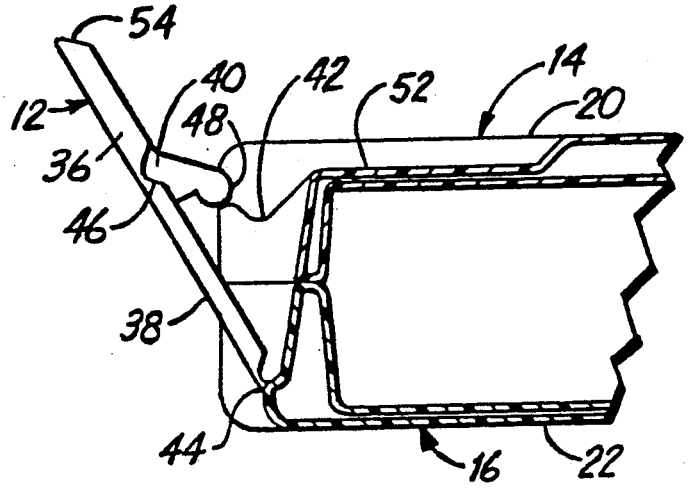
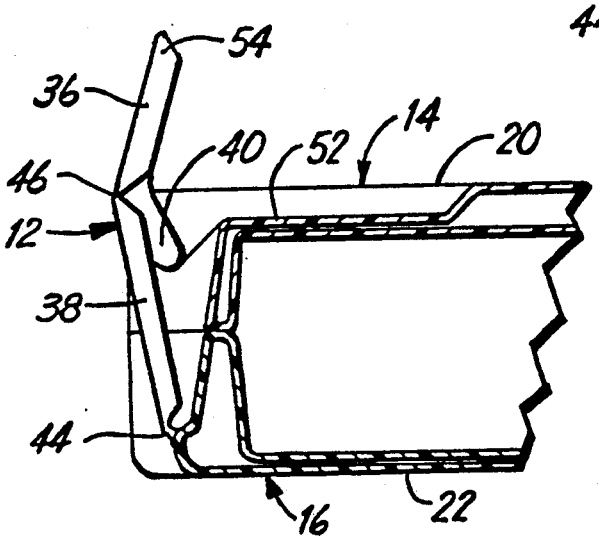
Fig. 5
Fig. 6
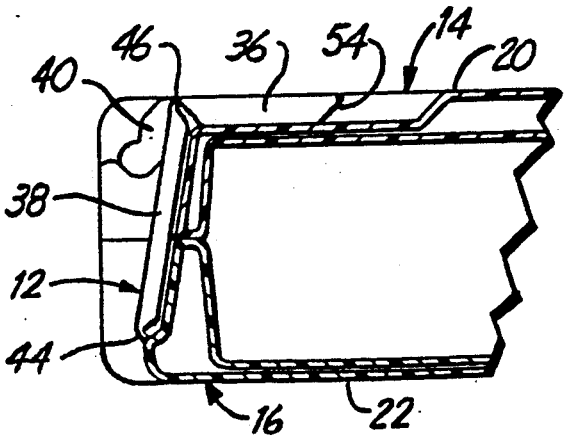

INTEGRAL OVER-CENTER TOGGLE LATCH FOR USE WITH A MOLDED CASE

BACKGROUND OF THE INVENTION

The present invention relates generally to over-center toggle latches. More precisely, the invention relates to integral over-center toggle latches for use with molded cases.

Over-center latches are generally known, and used in a variety of applications. Latches of these types are shown in the following U.S. Pat. Nos.:

| Inventor | U.S. Pat. No. |
|---|---|
| Avitable | 4,813,735 |
| Bisbing | 4,687,237 |
| Lovelace, Jr. | 4,682,800 |
| Hinds | 4,588,216 |
| Tobey et al. | 4,532,674 |
| Kausch | 4,407,536 |

All of these latches are formed from a number of individual elements which must be assembled into a mechanically functioning unit. The assembled latch must then be mounted to the members it is to secure. These fabrication and assembly operations have associated costs which add to the overall cost of the product with which the latch is used.

There is a continuing need for improved over-center toggle latches. To be commercially viable, these latches must have a number of desirable characteristics. The latches must, of course, be strong and capable of securely holding together the parts to which they are mounted. The latches should be secure when in their locked positions so that jostling will not cause unintended releasing. The latches should be relatively inexpensive to manufacture. They should also be unobtrusive (i.e., flush) to prevent them from inadvertently catching on other objects and inadvertently releasing.

SUMMARY OF THE INVENTION

The present invention is an over-center toggle latch for securing first and second members to one another. The toggle latch includes a hinge arm which has a first end and a second end spaced from the first. The first end of the hinge arm is coupled by a first hinge to a first member. The second end of the hinge arm is coupled by a second hinge to a lever arm. Attached to the lever arm is a projecting engagement member which is mounted to the lever arm and spaced from the second hinge. An engagement member-receiving seat is located on the second member. The latch is locked by actuating the lever arm to move the hinge arm to an over-center position, while the engagement member is pivotally engaged with the seat.

In one preferred embodiment, the hinge arm, first hinge, second hinge, lever arm, and engagement member are all formed as an integral one-piece unit with a bottom member. The toggle latch hinges are "living hinges" formed from a thin wall web structure. The engagement member-receiving seat is formed integrally with the top member.

In another embodiment, the toggle latch of this invention is used for securing top and bottom members of a case joined by a hinge. The case is for storing a videocassette recorder (VCR) videocassette. A plurality of toggle latches having a common lever arm allows all of the toggle latches to be operated in unison when securing or releasing top and bottom members of the case.

BRIEF DESCRIPTION OF THE DRAWINGS

FIGS. 3–6 are side plan views of the toggle latch shown in FIG. 1, sequentially illustrating the operation of the latch as it is moved from an unlocked to a locked position.

DETAILED DESCRIPTION OF THE PREFERRED EMBODIMENTS

Figure 1:
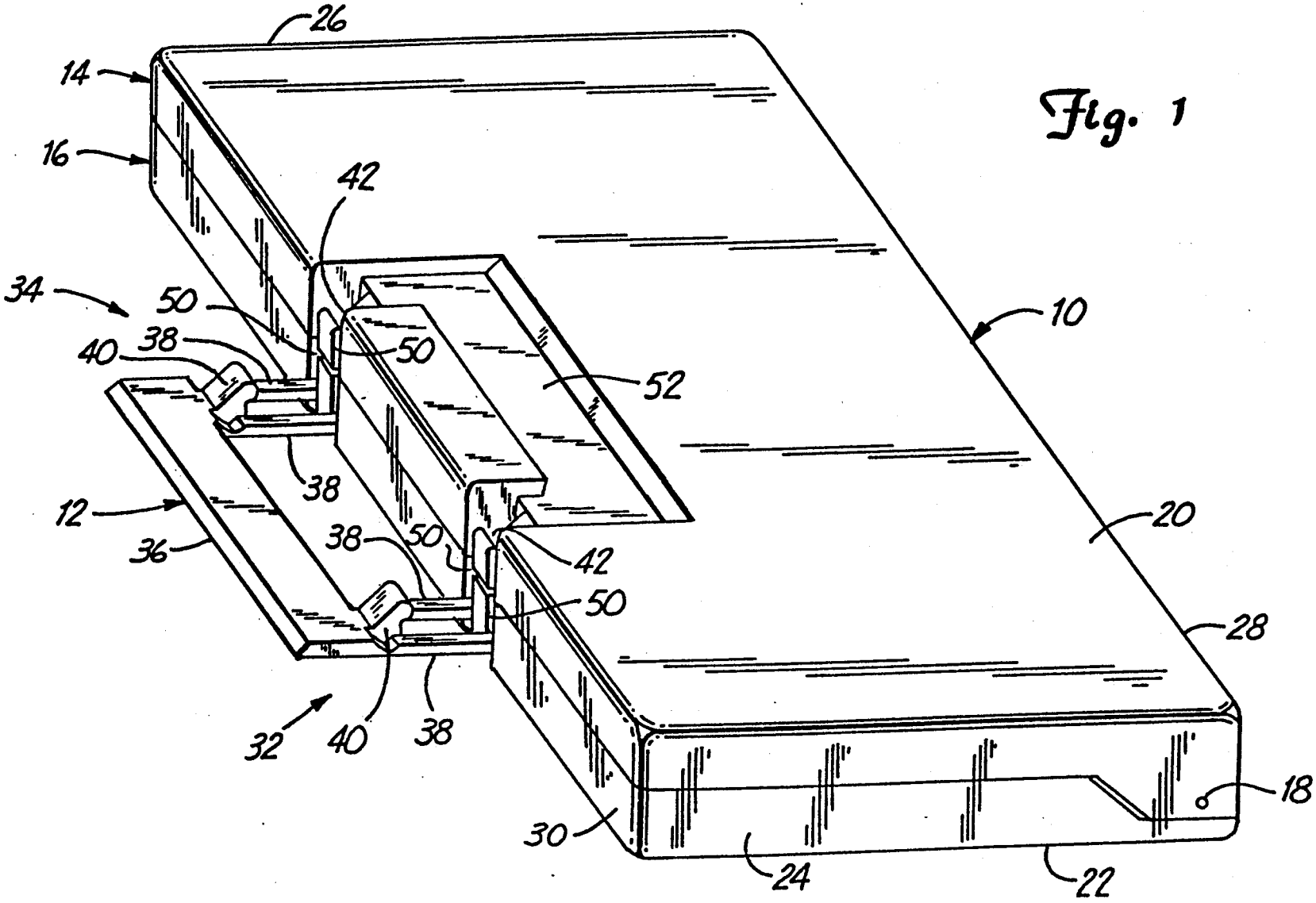
FIG. 1 is a perspective view of a case which includes an over-center toggle latch in accordance with the present invention.

A case 10 which includes an over-center toggle latch 12 in accordance with the present invention is illustrated in FIG. 1. Case 10 includes a first or top member 14 and a second or bottom member 16 which are movably connected together on one side by a hinge 18. Latch 12 is on the side of case 10 opposite hinge 18 in the embodiment shown, and is used to secure the free sides of members 14 and 16 to one another when the case is closed. As illustrated in FIG. 1, case 10 has a top panel 20, a bottom panel 22 and sidewalls 24, 26, 28, and 30. The top panel 20 and bottom panel 22 are generally parallel to one another, while the sidewalls 24, 26, 28, and 30 are perpendicular to these panels, when the case 10 is closed.

Figure 2:
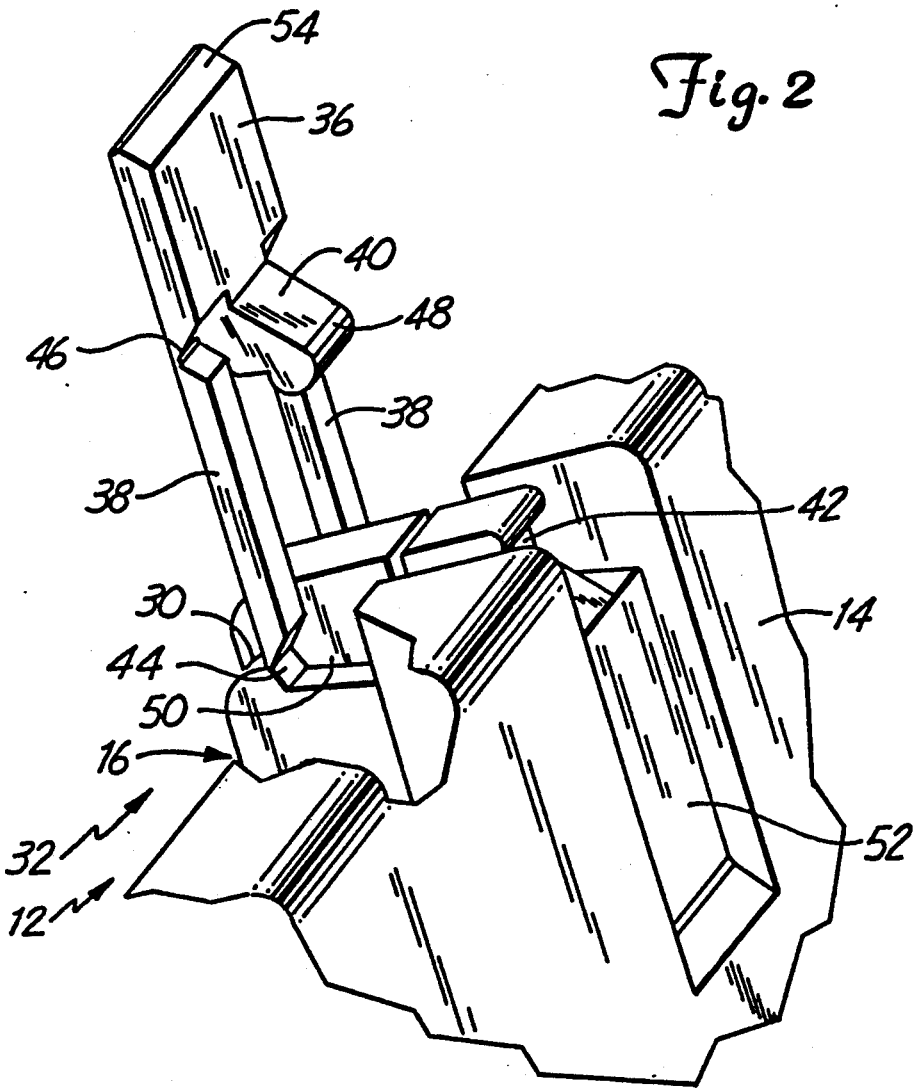
FIG. 2 is an enlarged, detailed, isometric view of one of the latch portions shown in FIG. 1.

The illustrated embodiment of latch 12 includes two separate but identical latch portions 32 and 34 which are operated in unison through the use of a common lever arm 36. Each latch portion 32 and 34 includes a pair of hinge arms 38, an associated portion of lever arm 36, a projecting engagement member 40 and an engagement member-receiving seat 42. Each hinge arm 38 has first and second spaced ends with first and second hinges 44 and 46, respectively (see FIG. 2). As best shown in FIG. 2, a first end of each hinge arm 38 of latch portion 32 is coupled to the sidewall 30 of the bottom member 16 by the first hinge 44. The second ends of hinge arms 38 are coupled to lever arm 36 by second hinges 46. Engagement member 40 is rigidly mounted to lever arm 36 between associated hinge arms 38. Engagement member 40 eXtends from lever arm 36 to a point spaced from and extending between the second hinge 46 and first hinge 44. At the end of engagement member 40 opposite the lever arm 36 is a curved surface 48 for pivotally engaging the engagement member-receiving seat 42 on side wall 30 of top member 14.

Case 10 is preferably fabricated from a polymer material which lends itself to manufacturing processes such as blow molding and injection molding. These manufacturing processes and materials are all known to those skilled in the art and therefore will not be discussed here. Toggle latch 12 is preferably molded integrally with the case 10.

Hinges 44 and 46 are "living hinges" formed from a thin walled web structure in the polymer material. The thin walled portions function as a hinge because the hinge arm 38 will bend at the points of thinnest material (i.e., hinges 44 and 46). The latch 12 can be made very inexpensively since it does not require separate assembly to the case or the added cost of separate manufacture.

The engagement member 40 extends from the portion of lever arm 36 closest to the second hinge 46. As seen in FIGS. 3 and 4, the engagement member 40 extends to a point opposite the second hinges 46 from lever arm 36 when the hinge arms 38 and lever arm 36 are coplanar. The engagement member 40 forms an obtuse angle with the portion of lever arm 36 furthest from the second hinges 46. The engagement member-receiving seat 42 is a fulcrum or pivot point for the engagement member 40. As engagement member 40 engages the engagement member-receiving seat 42 and as lever arm 36 is pivoted around hinge 46 toward the case 10 to force the engagement member 40 toward seat 42, a downward force acts on the engagement member 40 (through second hinge 46). Latch 12 generates forces which act in a manner which holds case members 14 and 16 together. The counteracting forces of case members 14 and 16 tend to hold engagement member 40 and engagement member-receiving seat 42 together when latch 12 is in its over-center locked position.

As lever arm 36 moves between an unlocked position and a locked position (the sequence illustrated in FIGS. 3,4,5, and 6), there is one point where the upward and downward forces acting to hold the engagement member 40 and the engagement member-receiving seat 42 into engagement reaches a maximum. The point of maximum force (i.e., the "center" position) occurs when the engagement member 40 is centered between the hinge arms 38 and in a plane defined by the first and second hinges. Positioning the lever arm 36 on either side of the point where maximum force occurs reduces the force holding engagement member 40 into engagement with engagement member-receiving seat 42. Latch 12 is in its over-center position (FIG. 6) when the plane defined by hinges 44 and 46 passes beyond the point at which engagement member 40 pivotally engages seat 42.

The positioning of the lever arm 36 in the locked (over-center) position (see FIG. 6) causes little force, if any, to act on first hinges 44 and second hinges 46. As described above, the over-center position is one at which the latch is moved to a position where a line extending between hinges 44 and 46 has passed the point of maximum force. Once the lever arm 36 is in the locked position, unbalanced forces acting to separate top member 14 from bottom member 16 tend to force lever arm 36 toward the locked position. Recesses 50 in sidewall 30 allow hinge arms 38 to be received within the surface of sidewall 30 when the latch is in the locked position. A recessed portion 52 in top panel 20 allows the lever arm 36 to fold over (bending at the second hinge 46) and lie flush with the top panel 20 when in the locked position.

In operation, as shown in FIGS. 3–6, toggle latch 12 is used to lock case 10. As hinge arm 38 is moved toward top member 14, the curved end 48 of engagement member 40 engages the engagement member-receiving seat 42. As this motion is continued and force is applied to lever arm 36, top member 14 and bottom member 16 are forced together by a downward force exerted by engagement member 40 on top member 14 and an upward force exerted by first hinge 44 on bottom member 16 caused by the hinge arms 38 pulling upwardly at the first hinge 44. This upward pulling force is created as the curved surface 48 contacts and pivots around the engagement member receiving seat 42. Force is continuously applied to the lever arm 36 until the lever arm 36 passes the over-center position. The over-center position is the point where the curved surface 48, while in engagement with the engagement member-receiving seat 42, is in a plane defined by hinge arms 38. After passing the over-center position, the lever arm 36 moves to the locked position.

Toggle latch 12 is released from the locked position by lifting up on beveled edge 54 of lever arm 36, causing the lever arm 36 to move through the overcenter position with respect to the engagement member 40. As lever arm 36 pivots on the first hinges 44 away from case 10, engagement member 40 moves clear from the engagement member-receiving seat 42, thus allowing top member 14 to separate from bottom member 16.

The toggle latch of the present invention has a number of important features and advantages. Each of the two separate parts of the toggle latch (hinges 44 and 46, lever arm 36, hinge arms 38 and engagement member 40 attached to case member 16, and seat 42 of case member 14) can be molded integrally with the associated case member to reduce manufacturing costs. The only added cost of the latch is from the added material used to form the latch. Manufacturing costs are reduced because there are no assembly steps for the molded latch. The use of two hinges, neither of which is required to bend more than 90 degrees during operation, adds to the lifetime of the hinge. The lifetime of a "living hinge" is directly related to the amount of motion required of the hinge during operation. Therefore, a hinge requiring only 90 degrees motion will have a greater lifetime than a hinge requiring greater amounts of motion. Although the hinges are not required to bend more than 90 degrees for operation, those described with reference to the illustrated embodiments are capable of doing so. In addition, the present latch can be positioned flush with the case in its latched position, making it non-obtrusive and protecting the latch from inadvertent releasing. The polymer material has sufficient strength at the hinged portions to secure the case. Furthermore, once in the locked position, the lever arm resists release because any force applied to separate the top and bottom members tends to act to keep the lever arm in the locked position.

Although the present invention has been described with reference to preferred embodiments, workers skilled in the art will recognize that changes may be made in form and detail without departing from the spirit and scope of the invention.

What is claimed is:

1. An over-center toggle latch for securing first and second members to one another, including:

a hinge arm having first and second spaced ends;

a first hinge for coupling the first end of the hinge arm to the first member;

a lever arm, wherein the lever arm has a first end and a second end;

a second hinge for coupling the first end of the lever arm to the second end of the hinge arm;

an engagement member-receiving seat in the second member; and an engagement member mounted to the lever arm adjacent to the first end of the lever arm and spaced from the second hinge, for pivotally engaging the seat, the latch configured for motion between an unlocked position at which the engagement member is disengaged from the seat, and a locked position at which the engagement member is engaged with the seat and the hinge arm is in an over-center position with respect to the engagement member and seat, wherein when the hinge arm is in the over-center position the first and second hinges are placed in an untensioned state.

2. The latch of claim 1 wherein the first and second hinges are living hinges and the hinge arm, lever arm and engagement member form an integral, one-piece unit with the first member.

3. The latch of claim 1 wherein:

the latch is configured for use with first and second members having sides and edges having recesses, the edges meeting and being generally coplanar and perpendicular to the sides when the members are secured by the latch;

the engagement member-receiving seat is in the edge of the second member; and the engagement member includes:

a pivotal engagement portion; and a mounting structure for mounting the pivotal engagement portion to the lever arm in such a manner that the hinge arm will be received within the recess in the edge, and the lever arm will be received within the recess in the side of the second member.

4. The latch of claim 1 and including a plurality of over-center toggle latches, each sharing a common lever arm.

5. The latch of claim 1, wherein the engagement member is attached to the lever arm so as to form an obtuse angle with the lever arm.

6. The latch of claim 1 wherein in the locked position the lever arm can be disposed against a different surface of the second member than the hinge arm.

7. An over-center toggle latch for securing first and second members to one another, including:

a hinge arm having first and second spaced ends;

a first hinge for coupling the first end of the hinge arm to the first member;

a lever arm;

a second hinge for coupling the lever arm to the second end of the hinge arm;

an engagement member-receiving seat in the second member; and an engagement member mounted to the lever arm and spaced from the second hinge, for pivotally engaging the seat, the latch configured for motion between an unlocked position at which the engagement member is disengaged from the seat, and a locked position at which the engagement member is engaged with the seat and the hinge arm is in an over-center position with respect to the engagement member and seat, wherein when the hinge arm is in the over-center position the first and second hinges are placed in an untensioned state;

wherein during movement of the latch from the unlocked position toward the locked position the hinge arm unidirectionally pivots toward the second member.

8. The latch of claim 7 wherein the first and second hinges are living hinges and the hinge arm, lever arm and engagement member form an integral, one-piece unit with the first member.

9. The latch of claim 7 wherein:

the latch is configured for use with first and second members having sides and edges having recesses, the edges meeting and being generally coplanar and perpendicular to the sides when the members are secured by the latch;

the latch seat is in the edge of the second member; and the engagement member includes: a pivotal engagement portion; and a mounting structure for mounting the pivotal engagement portion of the lever arm in such a manner that the hinge arm will be received within the recess in the edge, and the lever arm will be received within the recess in the side of the second member.

10. The latch of claim 7 and including a plurality of over-center toggle latches, each sharing a common lever arm.

11. The latch of claim 7 wherein the engagement member is attached to the lever arm so as to form an obtuse angle with the lever arm.

12. A molded case having first member and second member movably attached to one another and an integral, over-center toggle latch, including:

a hinge arm having first and second spaced ends;

a first living hinge for coupling the first end of the hinge arm to the first member;

a lever arm, wherein the lever arm has a first end and a second end;

a second living hinge for coupling the first end of the lever arm to the second end of the hinge arm;

an engagement member-receiving seat in the second member; and an engagement member mounted to the lever arm adjacent to the first end of the lever arm and spaced from the second hinge, for pivotally engaging the seat, the latch configured for motion between an unlocked position at which the engagement member is disengaged from the seat, and a locked position at which the engagement member is engaged with the seat and the hinge arm is in an over-center position with respect to the engagement member and seat, wherein when the hinge arm is in the over-center position the first and second hinges are placed in an untensioned state.

13. The case of claim 12 wherein:

the latch is configured for use with first and second members having sides and edges having recesses, the edges meeting and being generally coplanar and perpendicular to the sides when the members are secured by the latch;

the engagement member-receiving seat is in the edge of the second member; and the engagement member includes: a pivotal engagement portion; and a mounting structure for mounting the pivotal engagement portion to the lever arm in such a manner that the hinge arm will be received within the recess in the edge and the lever arm will be received within the recess in the side of the second member.

14. The case of claim 12 wherein the case includes: a recess for receiving the lever arm and the hinge arm.

15. A molded case having first member and second member movably attached to one another and an integral, a hinge arm having first and second spaced ends;

a first living hinge for coupling the first end of the hinge arm to the first member;

a lever arm;

a second living hinge for coupling the lever arm to the second end of the hinge arm;

an engagement member-receiving seat in the second member; and an engagement member mounted to the lever arm and spaced from the second hinge, for pivotally engaging the seat, the latch configured for motion between an unlocked position at which the engagement member is disengaged from the seat, and a locked position at which the engagement member is engaged with the seat and the hinge arm is in an over-center position with respect to the engagement member and seat, wherein when the hinge arm is in the over-center position the first and second hinges are placed in an untensioned state;

wherein during movement of the latch from the unlocked position toward the locked position the hinge arm unidirectionally pivots toward the second member.

* * * * *

UNITED STATES PATENT AND TRADEMARK OFFICE

CERTIFICATE OF CORRECTION

PATENT NO. : 5,033,778

DATED : July 23, 1991

INVENTOR(S) : Gerald J. Niles, Davis W. Chamberlin, Jacqueline J. Forbes

It is certified that error appears in the above-indentified patent and that said Letters Patent is hereby corrected as shown below:

Col. 2, Line 46, "eXtends" should read --extends--.

Col. 4, Line 5, "overcenter" should read --over-center--.

Col. 6, Line 55, after "gral," insert --over-center toggle latch, including:--.

Signed and Sealed this

Sixth Day of September, 1994

Bruce Lehman

*Attest:*

BRUCE LEHMAN

*Attesting Officer*

*Commissioner of Patents and Trademarks*